US008947003B2

(12) United States Patent
Tofilescu et al.

(10) Patent No.: US 8,947,003 B2
(45) Date of Patent: Feb. 3, 2015

(54) CIRCUIT AND METHOD FOR INDEPENDENT CONTROL OF SERIES CONNECTED LIGHT EMITTING DIODES

(71) Applicant: Flextronics Automotive Inc., Newmarket, Ontario (CA)

(72) Inventors: Pompilian Tofilescu, Ontario (CA); Alexander Ermilov, Ontario (CA)

(73) Assignee: Flextronics Automotive Inc., Newmarket, Ontario (CA)

( * ) Notice: Subject to any disclaimer, the term of this patent is extended or adjusted under 35 U.S.C. 154(b) by 61 days.

(21) Appl. No.: 13/852,068

(22) Filed: Mar. 28, 2013

(65) Prior Publication Data

US 2014/0292216 A1 Oct. 2, 2014

(51) Int. Cl.
*H05B 37/00* (2006.01)
*H05B 33/08* (2006.01)

(52) U.S. Cl.
CPC ..... *H05B 33/0824* (2013.01); *H05B 33/083* (2013.01)
USPC ..... 315/185 R; 315/119; 315/185 S; 315/193

(58) Field of Classification Search
USPC ..... 315/119, 185 R, 185 S, 193
See application file for complete search history.

(56) References Cited

U.S. PATENT DOCUMENTS

| | | | | |
|---|---|---|---|---|
| 2007/0257623 | A1* | 11/2007 | Johnson et al. | 315/193 |
| 2008/0048567 | A1 | 2/2008 | Steele et al. | |
| 2009/0179575 | A1* | 7/2009 | Mednik et al. | 315/193 |
| 2010/0308738 | A1* | 12/2010 | Shteynberg et al. | 315/185 R |
| 2011/0210674 | A1* | 9/2011 | Melanson | 315/185 R |
| 2011/0273102 | A1* | 11/2011 | van de Ven et al. | 315/193 |
| 2012/0081009 | A1* | 4/2012 | Shteynberg et al. | 315/122 |
| 2013/0119872 | A1* | 5/2013 | Chobot | 315/185 R |
| 2013/0162151 | A1* | 6/2013 | van de Ven et al. | 315/187 |
| 2013/0307424 | A1* | 11/2013 | Gray et al. | 315/193 |

FOREIGN PATENT DOCUMENTS

WO 2012131602 A1 10/2012

* cited by examiner

*Primary Examiner* — Jason M Crawford
(74) *Attorney, Agent, or Firm* — Volpe and Koenig, P.C.

(57) ABSTRACT

Described herein is a circuit and method for independent control of series connected light emitting diodes (LEDs). The circuit includes a first light emitting diode (LED) connected in series with a second LED. A current source is connected in series with the first LED and the second LED and a shunt circuit is connected in parallel with the first LED and the second LED. The shunt circuit includes a pair of serially connected resistors. The shunt circuit prevents inadvertent excitement of the LEDs due to leakage currents but minimally affect illumination characteristics of the LEDs. A pair of transistors is connected to the first LED and the second LED, respectively, and is biased using a set of bias resistors. A tri-state control signal switches on and off the pair of transistors and enables excitation of the first LED, the second LED or both via the current source.

16 Claims, 2 Drawing Sheets

100

100

CIRCUIT AND METHOD FOR INDEPENDENT CONTROL OF SERIES CONNECTED LIGHT EMITTING DIODES

FIELD OF INVENTION

This application is related to electronic circuits.

BACKGROUND

Light emitting diodes (LEDs) are used in many industries including, but not limited to, commercial, industrial, medical, automotive and the like. They are used in a variety of applications including, but not limited to, illumination elements for control panels and instrumentation clusters, and indicator lights or lamps in automobiles, medical equipment, and the like. Typically, these indictor lights use different color LEDs which have different electrical characteristics such as forward voltage and forward current. The conventional approach is to control each LED separately using a constant current or constant direct current (DC) voltage source, series and parallel resistors and a signal controlled switch.

SUMMARY

Described herein is a circuit and method for independent control of series connected light emitting diodes (LEDs). The circuit includes a first light emitting diode (LED) and a second LED connected in series with the first LED. A current source is connected in series with the first LED and the second LED and a shunt circuit is connected in parallel with the first LED and the second LED. The shunt circuit includes a pair of serially connected resistors. The shunt circuit reduces the current through a corresponding LED if the current sourced by the current source is higher than a forward current of the corresponding LED and prevents inadvertent excitement of the first and second LEDs due to leakage currents but minimally affect illumination characteristics of the first and second LEDs. A pair of transistors is connected to the first LED and the second LED, respectively, and is biased using a set of bias resistors. A tri-state control signal switches on and off the pair of transistors and enables excitation of the first LED, the second LED or both via the current source.

DETAILED DESCRIPTION

Figure 1:
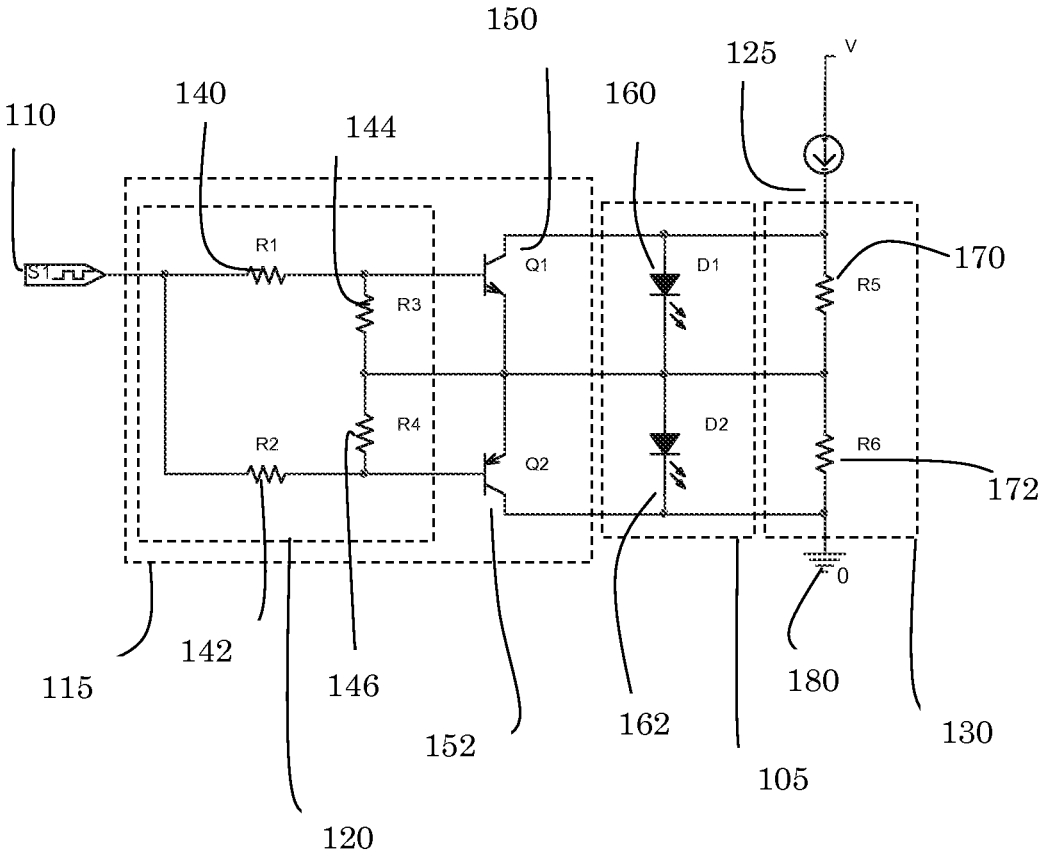
FIG. 1 is an embodiment of a circuit for independent control of series connected light emitting diodes (LEDs)

It is to be understood that the figures and descriptions of embodiments of a circuit and method for independent control of series connected light emitting diodes (LEDs) have been simplified to illustrate elements that are relevant for a clear understanding, while eliminating, for the purpose of clarity, many other elements found in typical applications. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein.

The non-limiting embodiments described herein are with respect to a circuit and method for independent control of series connected light emitting diodes (LEDs). Other electronic devices, modules and applications may also be used in view of these teachings without deviating from the spirit or scope as described herein. The circuit and method for independent control of series connected light emitting diodes (LEDs) may be modified for a variety of applications and uses while remaining within the spirit and scope of the claims. The embodiments and variations described herein, and/or shown in the drawings, are presented by way of example only and are not limiting as to the scope and spirit. The descriptions herein may be applicable to all embodiments of the circuit and method for independent control of series connected light emitting diodes (LEDs) although it may be described with respect to a particular embodiment.

Although the description is with respect to two LEDs, it is applicable to other configurations.

Described herein is a circuit 100 for independent control of series connected light emitting diodes (LEDs). The circuit 100 includes a LED circuit 105 that is controlled by a control signal S1 110 through a switching circuit 115, which also includes a biasing circuit 120 that properly biases the transistors in the switching circuit 115 to turn on and off as controlled by the control signal S1 110. The LED circuit 105 is powered by a constant current source 125. A shunt circuit 130 is connected in parallel with the LED circuit 105. Although a constant current source is shown in this embodiment, it is illustrative only and other equivalent circuits may be used.

In particular, the control signal S1 110 is connected to one end of a bias resistor R1 140 and a bias resistor R2 142. Another end of bias resistor R1 140 is connected to a base of a transistor Q1 150. Transistor Q1 150 is an npn transistor. Another end of bias resistor R2 142 is connected to a base of a transistor Q2 152. Transistor Q2 152 is a pnp transistor. A collector of transistor Q1 150 is connected to an anode of a LED D1 160, constant current source 125 output and one side of a shunt resistor R5 170. An emitter of transistor Q1 150 is connected to an emitter of Q2 152, a cathode of LED D1 160, an anode of LED D2 160, another side of shunt resistor R5 170, and one side of shunt resistor R6 172. A collector of transistor Q2 152 is connected to ground, a cathode of a LED D2 160 and another side of shunt resistor R6 172. Resistors R3 144 and R4 146 are connected between bases and emitters of transistor Q1 150 and transistor Q2 152, respectively.

The constant current source 125 will have one of the two states. An "off" state, when the current "I" provided by the constant current source 125 is considered zero amperes (0 A). In practice, the current will be the leakage current, $I_{leak}$, of the semiconductor devices that are used to make the constant current source 125. An "on" state, when the current "I" provided by the constant current source 125 needs to be equal or higher than the current required by the LEDs D1 160 and D2 162.

The control signal S1 110 will have one of the three states. A low "L" or logic "0" state, which is equivalent to 0 volts. A high "H" or logic "1" state, where the high state voltage needs to be higher than the sum of transistor Q1 150 base-emitter voltage and LED D2 162 forward voltage. A high impedance, "HZ", state, where the leakage current of the control signal S1 110, (i.e. output pin), in "HZ" state needs to be low enough not to inadvertently turn on one either of transistors Q1 150 and Q2 152.

When a transistor is turned on, the corresponding LED is short-circuited and does not illuminate, (i.e. LED is in an off state). For example, if Q1 150 (Q2 152) is on, then LED D1 160 (LED D2 161) is short-circuited and is in an off state. When the transistor is turned off, the current provided by the current source will go through the LED and the LED will illuminate, (i.e. LED is an on state). For example, if Q1 150 (Q2 152) is off, then current I from constant current source 125 will go through LED D1 160 (LED D2 161) and light will be emitted.

The biasing resistors in the bias circuit 115, R1 140, R2 142, R3 and R4, are chosen to ensure that the transistors Q1 150 and Q2 152 in the transistor circuit 120 are completely turned-on, (i.e. in the saturation region), by the control signal. An implementation, for illustrative purposes only, of the transistor circuit 120 and the bias resistor circuit 115 is a double npn and pnp digital transistor package, where resistors R1 140 and R2 142 are 2.2 k resistors and R3 144 and R4 146 are 47 k resistors. The transistors Q1 150 and Q2 152 are chosen such that the collector current datasheet specification will be higher than I, the output current from the constant current source 125.

The values for the shunt resistors R5 170 and R6 172 in the shunt circuit 130 are determined using equations (1) and (2) below:

$$R5=V_{D1}/(I-I_{D1}) \quad \text{Equation (1)}$$

$$R6=V_{D2}/(I-I_{D2}) \quad \text{Equation (2)}$$

where, $I_{D1}$ is the forward current for LED D1 160, $VF_{D1}$ is the forward voltage for LED D1 160, $I_{D2}$ is the forward current for LED D2 162, and $VF_{D2}$ is the forward voltage for LED D2 162. If $I=I_{D1}$ or $I=I_{D2}$, then R5 and R6 should be high enough 1) to reduce the current through a corresponding LED if the current provided by the current source is higher than the forward current of the LEDs as specified in a datasheet, and 2) not to reduce LED illumination under normal conditions and such that the constant current source leakage current does not excite the LEDs and create inadvertent illumination, effectively:

$$R5 \ll VF_{D1}/I_{leak}$$

$$R6 \ll VF_{D2}/I_{leak}$$

Figure 2:
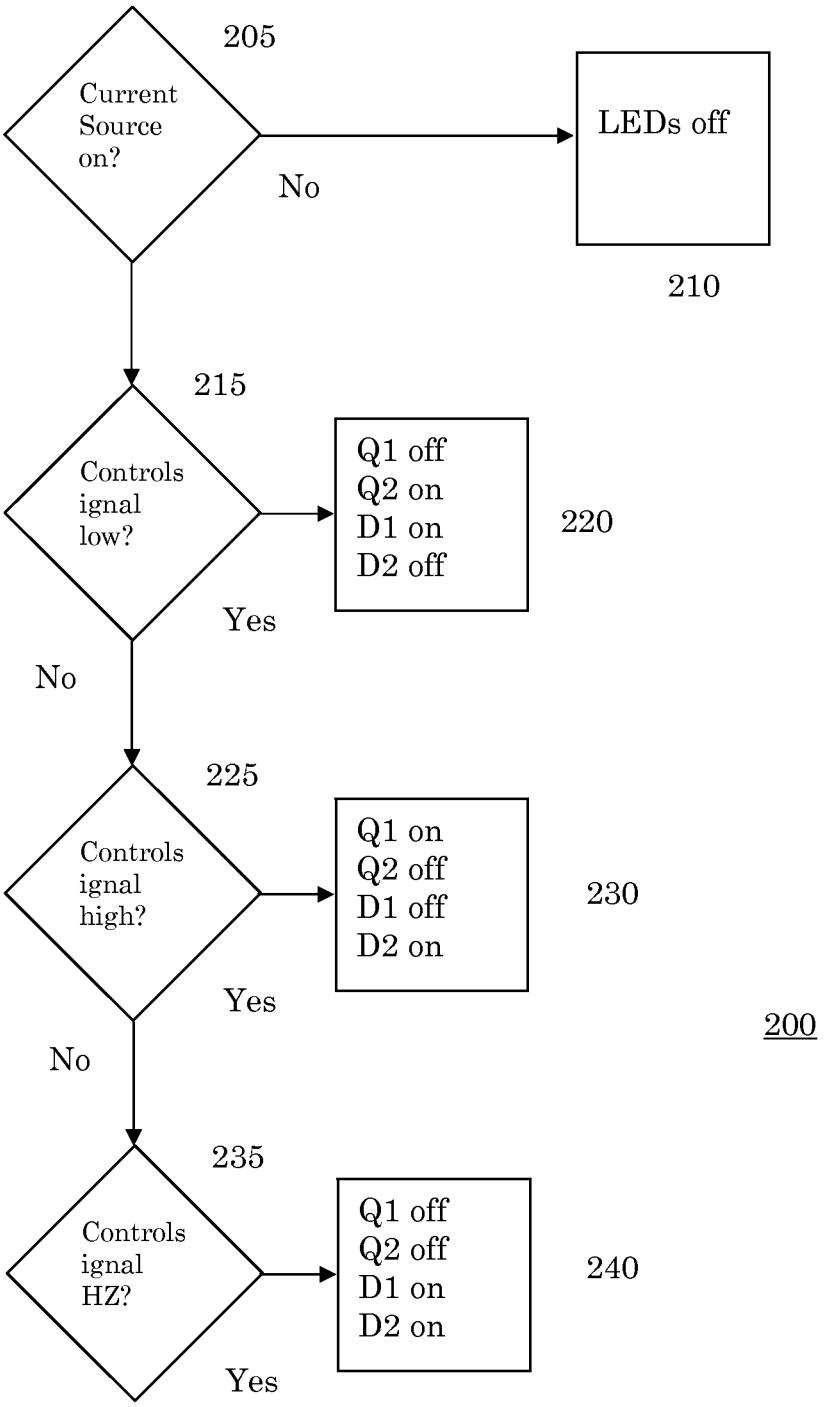
FIG. 2 is an example control method for independent control of series connected LEDs.

FIG. 2 and Table 1 describe and illustrate a control method 200 with reference to the circuit 100 of FIG. 1. If a constant current source 125 is off (205), then LEDs D1 160 and D2 162 are also off (210). If the constant current source 125 is on, then the state of the control signal S1 110 is determined (215). If the control signal S1 110 is low, then transistor Q1 150 is off and transistor Q2 152 is on, and accordingly LED D1 160 is on and LED D2 is off (220). If the control signal S1 110 is high (225), then transistor Q1 150 is on and transistor Q2 152 is off, and accordingly LED D1 160 is off and LED D2 is on (230). If the control signal S1 110 is at high impedance (HZ) (235), then transistor Q1 150 is off and transistor Q2 152 is off, and accordingly LED D1 160 is on and LED D2 is on (240).

TABLE 1

| | I (current source) | | | | |
|---|---|---|---|---|---|
| | S1 | Q1 | Q2 | D1 | D2 |
| Off | X | X | X | Off | Off |
| On | L | Off | On | On | Off |
| On | H | On | Off | Off | On |
| On | HZ | Off | Off | On | On |

The benefits of the above embodiment are that a smaller number of components are used. For example, in the above embodiment, a single constant current source is used versus two current sources for a conventional implementation. This also leads to power savings. For example, when both LEDs are lit, only half the power is consumed, (using one source versus using two current sources). Moreover, the number of microcontroller (MCU) output pins, (if an MCU is used as a source of control signals), is reduced in half. Therefore, a smaller MCU package is required. The above embodiment also requires a smaller printed circuit board (PCB) area due to a smaller component count and MCU package. The decrease in the number of parts also results in cost reductions.

In general, embodiments for a circuit and method for independent control of series connected light emitting diodes (LEDs) are described herein. The circuit includes a first light emitting diode (LED) and a second LED connected in series with the first LED. A current source is connected in series with the first LED and the second LED and a shunt circuit is connected in parallel with the first LED and the second LED. A switching circuit is configured to receive a control signal and is connected to the first LED and the second LED. The switching circuit, the first LED and the second LED are responsive to a state of the control signal. The switching circuit includes a first transistor connected in series with a second transistor, the first transistor connected to the first LED and the current source and the second transistor connected to the second LED and ground. The switching circuit includes a bias circuit which includes a first pair of resistors connected to the first transistor and a second pair of resistors connected to the second transistor. The shunt circuit includes a pair of serially connected resistors configured to reduce current through a corresponding LED if the current sourced by the current source is higher than a forward current of the corresponding LED and to prevent inadvertent excitement of the first LED and the second LED due to leakage currents but minimally affect illumination characteristic of the first LED and the second LED. The control signal has a first state for exciting the first LED, a second state for exciting the second LED and a third state for exciting the first LED and the second LED.

In general, an electronic device includes a first light emitting diode (LED) connected in series with a second LED and a constant current source connected to the first LED and the second LED. A transistor circuit is connected to the first LED and the second LED and the transistor circuit is configured to receive a tri-state control signal. The tri-state control signal permits excitation of at least one of the first LED and the second LED. The transistor circuit includes a first transistor connected to the first LED and an output of the constant current source and a second transistor connected to the second LED and ground. The transistor circuit includes a resistor biasing circuit which has a first pair of resistors connected to the first transistor and a second pair of resistors connected to the second transistor. The first LED is in off state on a condition that the first transistor is on and the second LED is in off state on a condition that the second transistor is on. The first LED and the second LED are in an on state on a condition that the first transistor and the second transistor are off. A shunt circuit is configured to prevent inadvertent excitement of the first LED and the second LED due to leakage currents but minimally affect illumination characteristic of the first LED and the second LED. The tri-state control signal has a first state for exciting the first LED, a second state for exciting the second LED and a third state for exciting the first LED and the second LED.

As described herein, the methods described herein are not limited to any particular element(s) that perform(s) any particular function(s) and some steps of the methods presented need not necessarily occur in the order shown. For example, in some cases two or more method steps may occur in a different order or simultaneously. In addition, some steps of the described methods may be optional (even if not explicitly stated to be optional) and, therefore, may be omitted. These and other variations of the methods disclosed herein will be readily apparent, especially in view of the description of the circuit for independent control of series connected light emitting diodes (LEDs) described herein, and are considered to be within the full scope of the invention.

Although features and elements are described above in particular combinations, each feature or element can be used alone without the other features and elements or in various combinations with or without other features and elements.

What is claimed is:

1. A circuit, comprising:

a first light emitting diode (LED);

a second LED connected in series with the first LED;

a current source connected in series with the first LED and the second LED;

a shunt circuit connected in parallel with the first LED and the second LED; and a switching circuit configured to receive a control signal and connected to the first LED and the second LED;

wherein the switching circuit, the first LED and the second LED are responsive to a state of the control signal, and wherein the switching circuit includes a first transistor connected in series with a second transistor, the first transistor connected to the first LED and the current source and the second transistor connected to the second LED and ground.

2. The circuit of claim 1, wherein the switching circuit includes a bias circuit which includes a first pair of resistors connected to the first transistor and a second pair of resistors connected to the second transistor.

3. The circuit of claim 1, wherein the shunt circuit includes a pair of serially connected resistors configured to reduce current through a corresponding LED if the current sourced by the current source is higher than a forward current of the corresponding LED and to prevent inadvertent excitement of the first LED and the second LED due to leakage currents but minimally affect illumination characteristic of the first LED and the second LED.

4. The circuit of claim 1, wherein the control signal has a first state for exciting the first LED, a second state for exciting the second LED and a third state for exciting the first LED and the second LED.

5. An electronic device, comprising:

a first light emitting diode (LED) connected in series with a second LED;

a constant current source connected to the first LED and the second LED;

a transistor circuit connected to the first LED and the second LED; and the transistor circuit configured to receive a tri-state control signal, the tri-state control signal permitting excitation of at least one of the first LED and the second LED, wherein the transistor circuit includes a first transistor connected to the first LED and an output of the constant current source and a second transistor connected to the second LED and ground.

6. The electronic device of claim 5, wherein the transistor circuit includes a resistor biasing circuit which has a first pair of resistors connected to the first transistor and a second pair of resistors connected to the second transistor.

7. The electronic device of claim 5, wherein the first LED is in off state on a condition that the first transistor is on.

8. The electronic device of claim 7, wherein the second LED is in off state on a condition that the second transistor is on.

9. The electronic device of claim 8, wherein the first LED and the second LED are in an on state on a condition that the first transistor and the second transistor are off.

10. The electronic device of claim 5, further comprising:

a shunt circuit configured to prevent inadvertent excitement of the first LED and the second LED due to leakage currents but minimally affect illumination characteristic of the first LED and the second LED.

11. The electronic device of claim 5, wherein the tri-state control signal has a first state for exciting the first LED, a second state for exciting the second LED and a third state for exciting the first LED and the second LED.

12. A method for independently controlling light emitting diodes (LEDs), comprising:

receiving a tri-state control signal at a switching network;

exciting at least one of a pair of serially connected LEDs via a current source on a condition that at least one of a pair of transistors in the switching network is in an off state in accordance with the tri-state control signal, wherein a first transistor of the pair of transistors is connected to a first LED of the pair of serially connected LEDs and a second transistor of the pair of transistors is connected to a second LED of the pair of serially connected LEDs; and connecting a shunt circuit in parallel to the pair of serially connected LEDs to reduce current through at least one LED of the pair of serially connected LEDs if the current sourced by the current source is higher than a forward current of the least one LED of the pair of serially connected LEDs and to prevent inadvertent excitement of the least one LED of the pair of serially connected LEDs due to leakage currents but minimally affect illumination characteristic of the least one LED of the pair of serially connected LEDs.

13. The method of claim 12, wherein a state for the pair of transistors and a state for the pair of serially connected LEDs are inverted.

14. The method of claim 12, wherein the switching network includes a resistor bias network which has a first pair of resistors connected to the first transistor and a second pair of resistors connected to the second transistor.

15. The method of claim 12, wherein the first LED is in off state on a condition that the first transistor is on and wherein the second LED is in off state on a condition that the second transistor is on.

16. The method of claim 12, wherein the first LED and the second LED are in an on state on a condition that the first transistor and the second transistor are off.

* * * * *